US012510333B2

(12) United States Patent
Kaplansky et al.

(10) Patent No.: US 12,510,333 B2
(45) Date of Patent: Dec. 30, 2025

(54) SINGLE WIRE HIT DETECTION APPARATUS

(71) Applicant: Battelle Memorial Institute, Columbus, OH (US)

(72) Inventors: Kevin Kaplansky, Columbus, OH (US); Gregory Gregoriades, Columbus, OH (US); John P. O'Brien, Worthington, OH (US); Greg Sisk, Hampton Cove, AL (US)

(73) Assignee: Battelle Memorial Institute, Columbus, OH (US)

( * ) Notice: Subject to any disclaimer, the term of this patent is extended or adjusted under 35 U.S.C. 154(b) by 295 days.

(21) Appl. No.: 18/318,149

(22) Filed: May 16, 2023

(65) Prior Publication Data

US 2023/0375313 A1 Nov. 23, 2023

Related U.S. Application Data

(60) Provisional application No. 63/343,159, filed on May 18, 2022.

(51) Int. Cl.
*F41J 5/00* (2006.01)
*F41J 5/052* (2006.01)

(52) U.S. Cl.
CPC ..... *F41J 5/052* (2013.01)

(58) Field of Classification Search
None
See application file for complete search history.

(56) References Cited

U.S. PATENT DOCUMENTS 3,585,497 A * 6/1971 Dalzell ..... F41J 5/041 324/705
4,240,640 A * 12/1980 LaMura ..... F41J 5/044 273/373
5,516,113 A * 5/1996 Hodge ..... F41J 5/041 178/18.05
5,669,608 A * 9/1997 Thomson ..... F41J 5/04 273/373
2021/0223005 A1 7/2021 Janssen

FOREIGN PATENT DOCUMENTS

GB 2342592 A 4/2000

OTHER PUBLICATIONS

International Search Report and Written Opinion from corresponding PCT Appln. No. PCT/US23/22343, dated Sep. 27, 2023.11 pages.

* cited by examiner

*Primary Examiner* — Sunit Pandya
(74) *Attorney, Agent, or Firm* — Grossman, Tucker, Perreault & Pfleger, PLLC; Donald G. Weiss

(57) ABSTRACT

In an approach to single wire hit detection, an apparatus comprises: a plurality of hit detection patches, each of the plurality of hit detection patches comprising an associated single coiled wire, and each of the plurality of hit detection patches being disposed overlapping at least one other hit detection patch of the plurality of hit detection patches; and a controller coupled to the associated single coiled wire of each hit detection patch of the plurality of hit detection patches, the controller configured to determine a location of one or more of the plurality of hit detection patches impacted by a projectile.

18 Claims, 10 Drawing Sheets

Bundle not hit
2 patches hit at overlap
2 patches out of play

System indicates that the darkened patches have been disrupted

Zone where hit reported by analysis

Projectile (actual impact)

Bundle not hit, hit somewhere in green zone

Only one patch out of play

Bundle not hit, hit somewhere in the green zone 2 patches hit at overlap
2 patches out of play Bundle hit right at the interface between the blue patches

- 2 blue patches out of play because they were hit
- 3 red patches out of play – hit at bundle Bundle not hit, hit somewhere in the green zone Two patches out of play

SINGLE WIRE HIT DETECTION APPARATUS

CROSS-REFERENCE TO RELATED APPLICATIONS

The present application claims the benefit of the filing date of U.S. Provisional Application Ser. No. 63/343,159, filed May 18, 2022, the entire teachings of which application is hereby incorporated herein by reference.

TECHNICAL FIELD

The present application relates generally to target sensors and, more particularly, to a single wire hit detection apparatus.

BACKGROUND

Weapon systems that utilize a kinetic impact to damage a target rely on the accuracy of the aiming system. As a result, the accurate measurement of a weapon system impact location is a critical piece of information to assess the accuracy of the weapon system. Additionally, this information can be used to determine the potential lethality of a weapon system against a target by measuring the propagation of the projectile. Current methods to measure the location of the impact include recording the timing of wire breaks in a witness screen. These current witness screens, however, have problems locating the impact when multi-fragment interceptor impacts are encountered.

BRIEF DESCRIPTION OF THE DRAWINGS

Reference should be made to the following detailed description which should be read in conjunction with the following figures, wherein like numerals represent like parts.

DETAILED DESCRIPTION

Figure 1A:
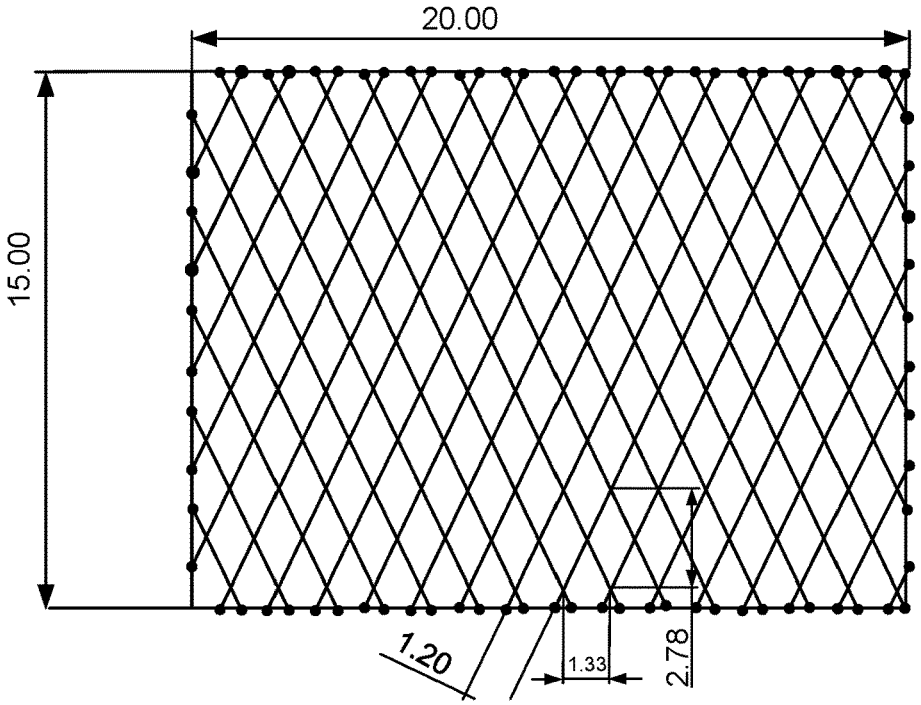
FIG. 1A is an example of an existing hit detection system grid.

The present disclosure is not limited in its application to the details of construction and the arrangement of components set forth in the following description or illustrated in the drawings. The examples described herein may be capable of other embodiments and of being practiced or being carried out in various ways. Also, it may be appreciated that the phraseology and terminology used herein is for the purpose of description and should not be regarded as limiting as such may be understood by one of skill in the art. Throughout the present description, like reference characters may indicate like structure throughout the several views, and such structure need not be separately discussed. Furthermore, any particular feature(s) of a particular exemplary embodiment may be equally applied to any other exemplary embodiment(s) of this specification as suitable. In other words, features between the various exemplary embodiments described herein are interchangeable, and not exclusive.

Hit detection systems have historically used grids with spacing on the order of one to two inches. These hit detection systems have been primarily used to detect the impact of a single interceptor. In the case of multi-fragment interceptor impacts, the impact of a single interceptor impedes the grid's ability to sense subsequent impacts not only in proximity to the initial impact, but also in areas throughout the grid. Wires broken at an impact point are no longer able to sense impacts along the entire length which they traverse. The problem with these grid systems is that each impact reduces coverage across the entire width and length of the grid, reducing detection probability/accuracy for subsequent impacts.

The present disclosure is a missile defense target hit detection system consisting of independent, discrete patches of wire routed in a striping or spiral pattern, e.g., a single coiled wire. The wire patches are monitored for continuity to detect the location at which a fragment hits the target, and, unlike existing grid systems which use two intersecting wires to detect a hit, a single wire is used to identify the hit location.

The wire patch design allows for greater flexibility. The number, size, and location of wire patches can be modified based on the needs of each test event. The patch design also eliminates the problem of artificial "dead spots" that are created when a multi-fragment interceptor impacts an existing wire grid design.

FIG. 1A is an example of an existing hit detection system grid. Hit detection systems have historically used grids with spacing on the order of one to two inches. This spacing is a result of a number of factors, including accuracy requirements, the size of the covered area, the number of wires that can be monitored by the electronics, the size of the anticipated projectile, the wire thickness, and the smallest target diameter. In the example of FIG. 1A, the diamond-shaped arrangement is due to the fact that grids are often designed to cover cylindrical and conical objects and are routed in such a fashion as to start at the aft end, progress to the forward end, reverse direction, and exit again at the aft end, at a point 180 degrees from the entry. This approach maximizes the amount of coverage each wire provides, while ensuring that each wire crosses each other wire in one uniquely identifiable location. As mentioned above, the problem with this configuration is that once a wire has been severed, any intersections incorporating that wire will not be able to distinguish any additional hits caused by any other fragments.

Figure 1B:
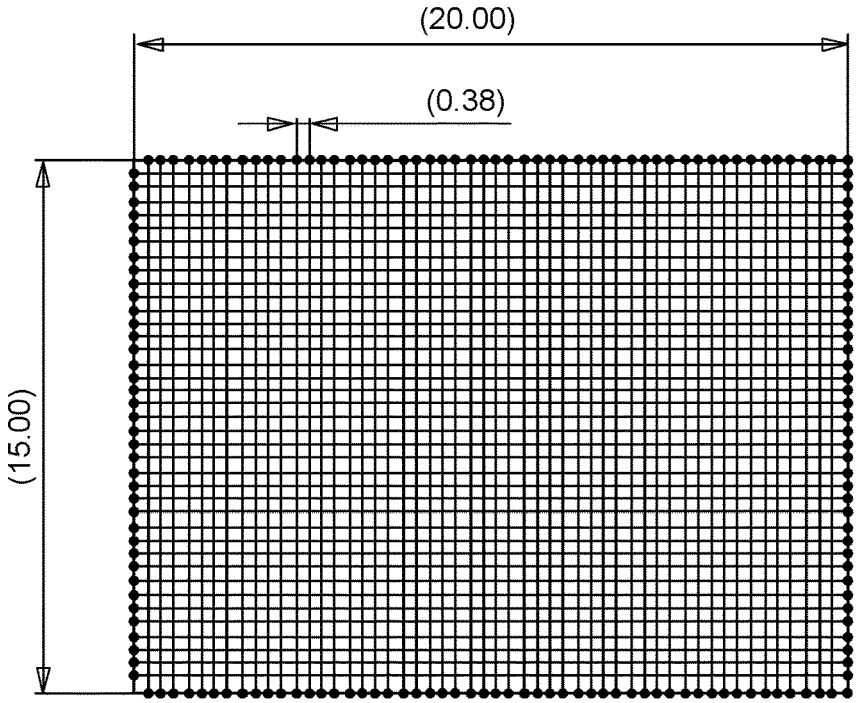
FIG. 1B is another example of an existing hit detection system grid.

FIG. 1B is another example of an existing hit detection system grid. In the example of FIG. 1B, a hit detection system is displayed that uses rectangular grids to cover flat areas such as cover plates. The spacing of the wires for these grids is driven by the same parameters as those driving the design of cylindrical or conical grids as described in FIG. 1A above. For the purpose of multi-fragment testing, the spacing is reduced to approximately three-eighths of an inch, in order to accommodate a notional fragment of the same size. As in the example of FIG. 1A above, each impact reduces coverage across the entire width and length of the grid, reducing detection probability and accuracy for subsequent impacts.

Figure 2:
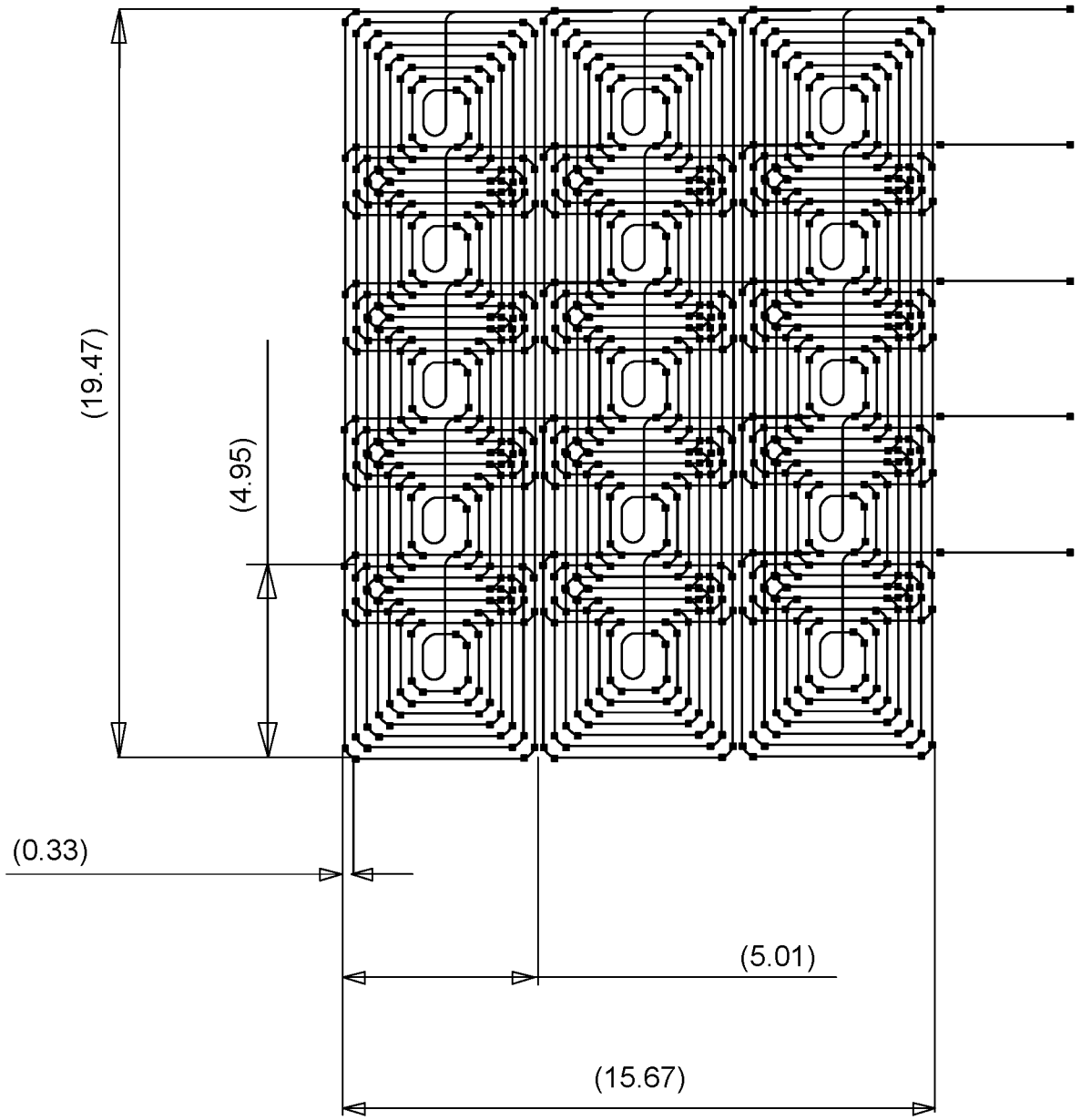
FIG. 2 is an example of a hit detection system using patches in place of grids.

FIG. 2 is an example of a hit detection system using patches in place of grids. Existing hit detection systems have been primarily used to detect the impact of a single interceptor. In the case of multi-fragment interceptor impacts, the impact of a single interceptor impedes the grid's ability to sense subsequent impacts not only in proximity to the initial impact, but also in areas throughout the grid. Wires broken at an impact point are no longer able to sense impacts along the entire length which they traverse. An approach that reduces this effect is to arrange wires so that they provide coverage to a limited "patch," through routing in a zigzag, spiral, or other pattern. Unlike grid patterns, patch coverage requires wire leads to be routed to patches throughout the coverage area. These wire leads, if broken outside their patch area, may be interpreted as a "hit" to the patch area, even if occurs outside this area. This can be mitigated by routing wire leads radially in the overall assembly. If this is not practical, patches may be overlapped, so that the wire leads of one patch are covered by a neighboring patch. This allows one to draw conclusions as to whether a wire break is due to an impact at a patch or a wire lead. This analysis is done using visual illustration or animation tools after the data has been collected.

Figure 3A:
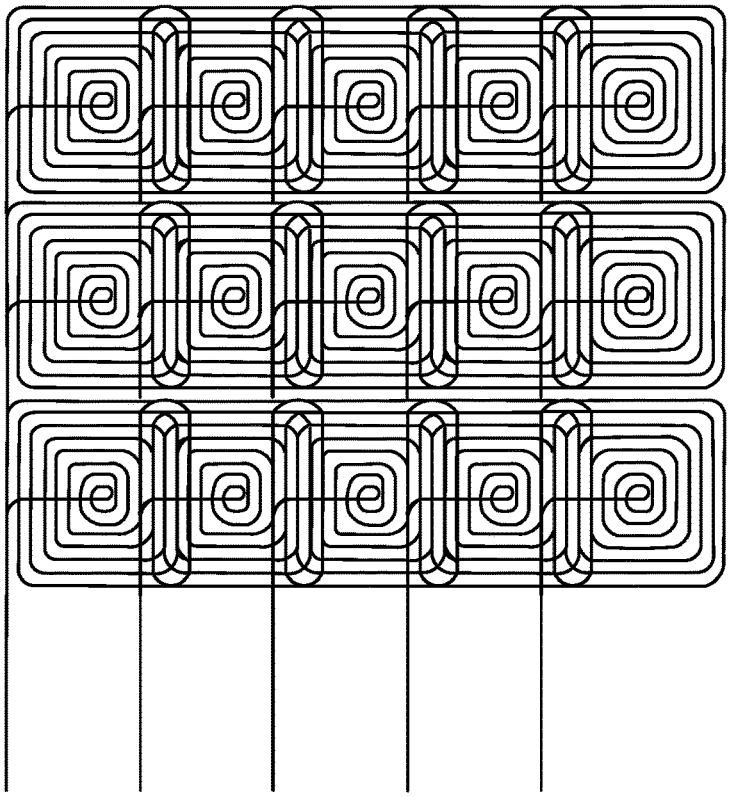
FIG. 3A is an example of a hit detection system using overlapped patches.

FIG. 3A is an example of a hit detection system using a plurality of overlapped hit detection patches. Each of the plurality of hit detection patches is disposed overlapping at least one other hit detection patch.

Figure 3B:
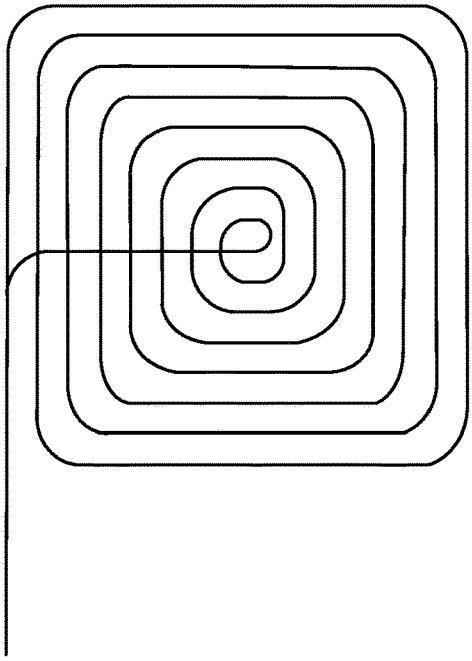
FIG. 3B is a close-up of a single patch from the hit detection system of FIG. 3A.

FIG. 3B is a close-up of one example of a single patch from the hit detection system of FIG. 3A. In the example patch of FIG. 3B, each hit detection patch comprises an associated single coiled wire, where each end of the associated single coil wire consists of a wire lead to connect to a controller.

Figure 4:
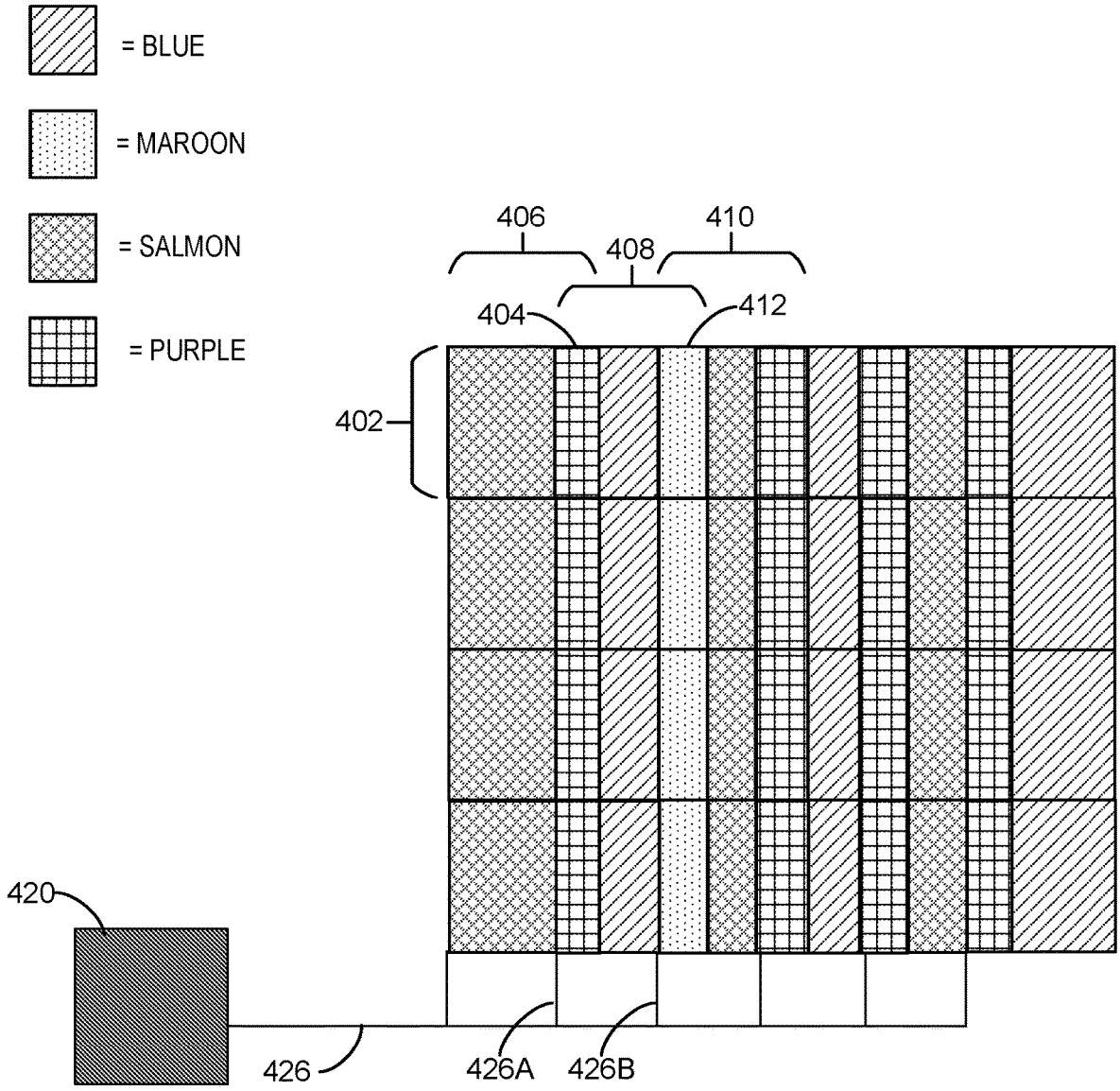
FIG. 4 is an example of the layout of overlapping patches from the hit detection system of FIG. 3A.

FIG. 4 is an example of the layout of overlapping patches from the hit detection system of FIG. 3A. In the example of FIG. 4, an array of patches is arranged as four rows, each row containing six patches. Row 402 contains patch 406, patch 408, and patch 410. As can be seen, in this example each interior patch overlaps the adjacent patch on the left side of the patch. So, for this example, patch 408 overlaps patch 406, as shown by overlap 404. Likewise, patch 410 overlaps patch 408, as shown by overlap 412. In the example of FIG. 4, the patches in each column overlap the patches in an adjacent column, i.e., all the patches in the column of patch 408 overlap the adjacent patches in the column of patch 406.

FIG. 4 also shows controller 420, which monitors the wire lead bundles 426 from each patch. When controller 420 detects a loss of continuity in any wire lead of the one or more wired leads in the wire lead bundles 426, then controller 420 can determine the location of an impact based on which of the one or more wire leads have lost continuity. Controller 420 may be configured to provide an output representative of the location on the plurality of hit detection patches impacted by a projectile.

Wire lead bundle 426A, for example, contains the bundle of wire leads from all the blue patches in the column containing patch 408 (in this example, all wire leads run vertically down the left edge of the column, so wire lead bundle 426A contains the bundle of wire leads from the blue patches in the second column). Likewise, wire lead bundle 426B contains the bundle of wire leads from the red patches in the third column, i.e., patch 410 and all the red patches below patch 410 in the third column. In some embodiments, the bundle is positioned beneath an area of overlapping of adjacent hit detection patches, for example, the bundle for 406 and patch 408 may run beneath overlap 404.

The example layout of FIG. 4 will be used to explain the function of the hit detection system using overlapped patches in FIGS. 5-9 below.

Figure 5:
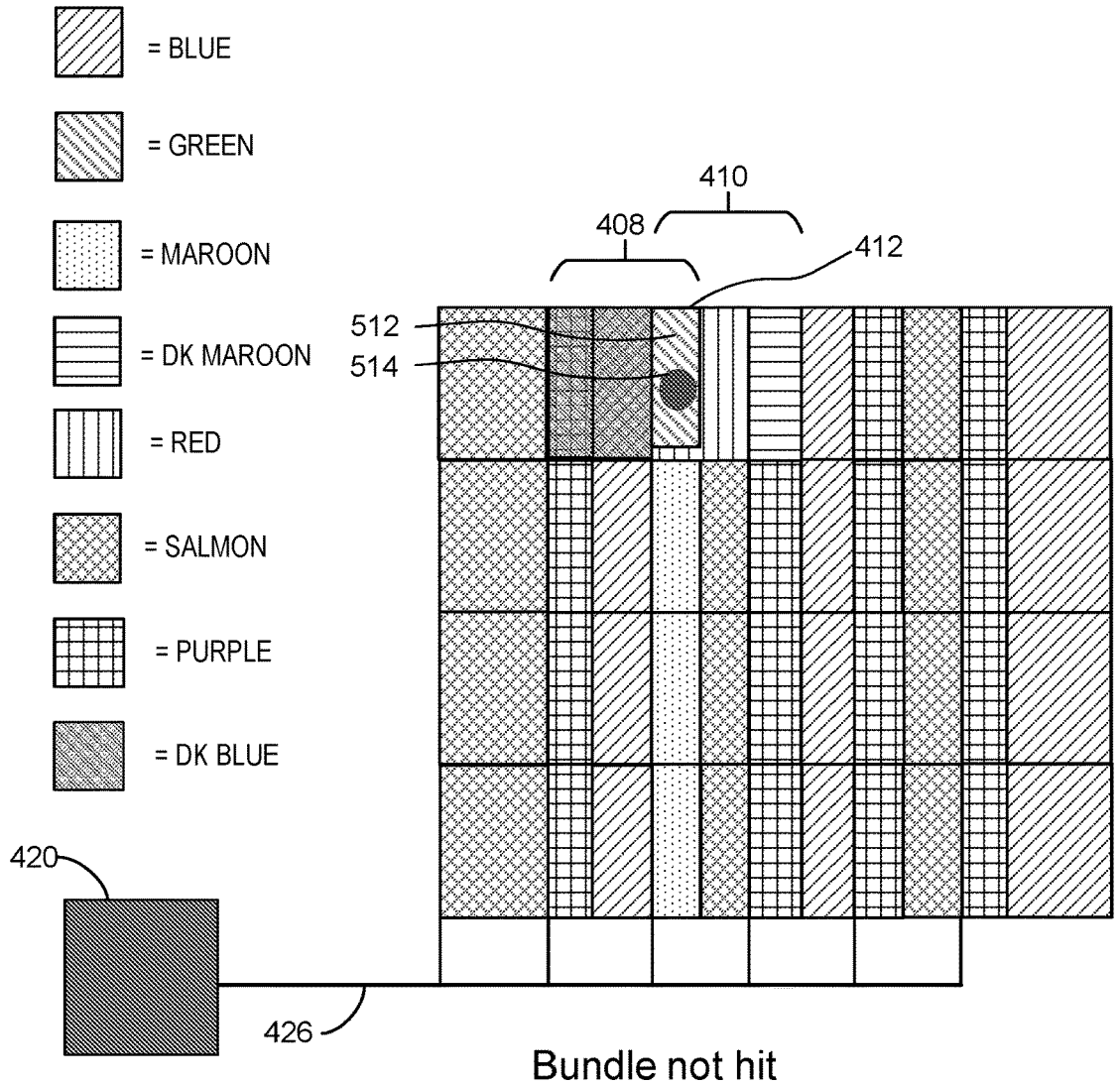
FIG. 5 is an example analysis of a hit where two patches are hit at an overlap.

FIG. 5 is an example analysis of a hit where two patches are hit at an overlap. In the example of FIG. 5, projectile impact 514 has occurred in the overlap 412 between patch 408 and patch 410 but has not hit the wire lead bundle 426. Based on the analysis of the damaged patches, overlap zone 512 is reported to be the area of the hit.

Since projectile impact 514 occurred within overlap 412, both patch 408 and patch 410 are out of play for further impacts, but since wire lead bundle 426 was not hit, no additional patches are out of play for further impacts, and all remaining patches may detect further impacts.

Figure 6:
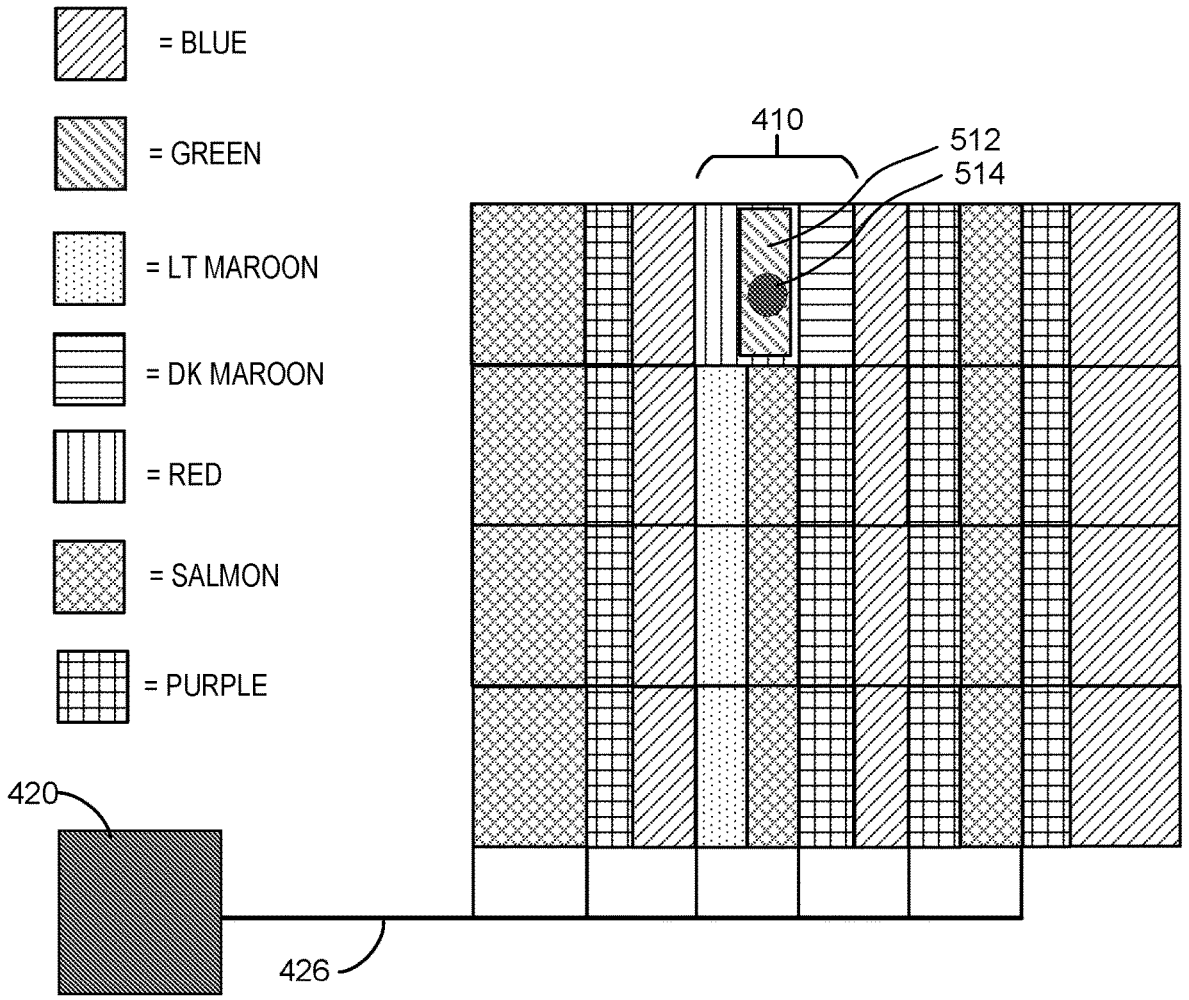
FIG. 6 is an example analysis of a hit where one patch is hit, but not at an overlap.

FIG. 6 is an example analysis of a hit where one patch is hit, but not at an overlap. In this example, since projectile impact 514 did not occur within the overlap between two patches, only patch 410 is out of play for further impacts. Based on this fact, overlap zone 512 is reported to be the area of the hit. All patches other than patch 410 may detect further impacts.

Figure 7:
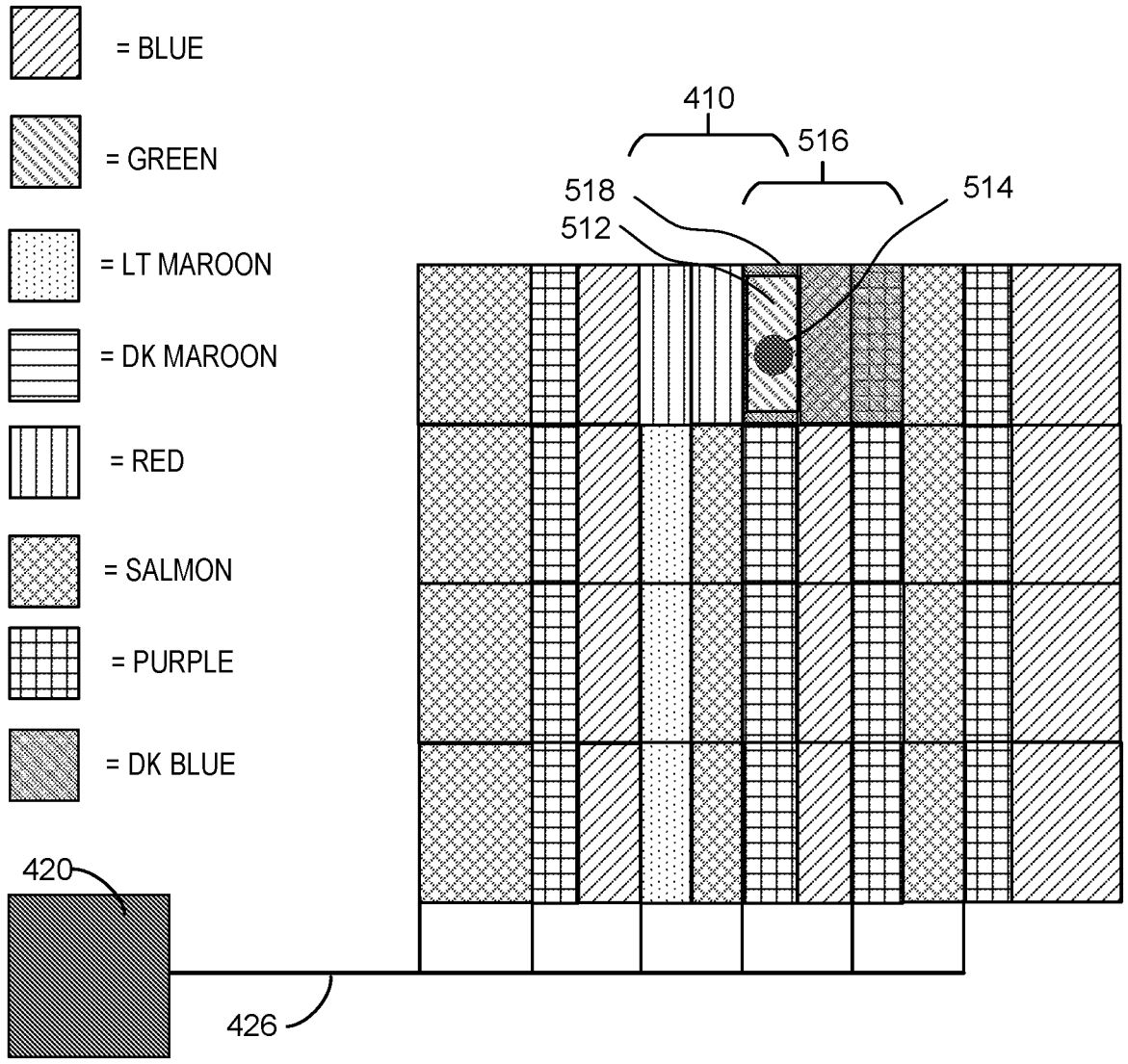
FIG. 7 is another example analysis of a hit where two patches are hit at an overlap.

FIG. 7 is another example analysis of a hit where two patches are hit at an overlap. In the example of FIG. 7, projectile impact 514 has occurred in the overlap zone 512 between patch 410 and patch 516 but has not hit a wire lead bundle 426. Based on the analysis of the damaged patches, overlap zone 512 is reported to be the area of the hit.

Since projectile impact 514 occurred within overlap 518, both patch 410 and patch 516 are out of play for further impacts, but since wire lead bundle 426 was not hit, no additional patches are out of play, and all remaining patches may detect further impacts.

Figure 8:
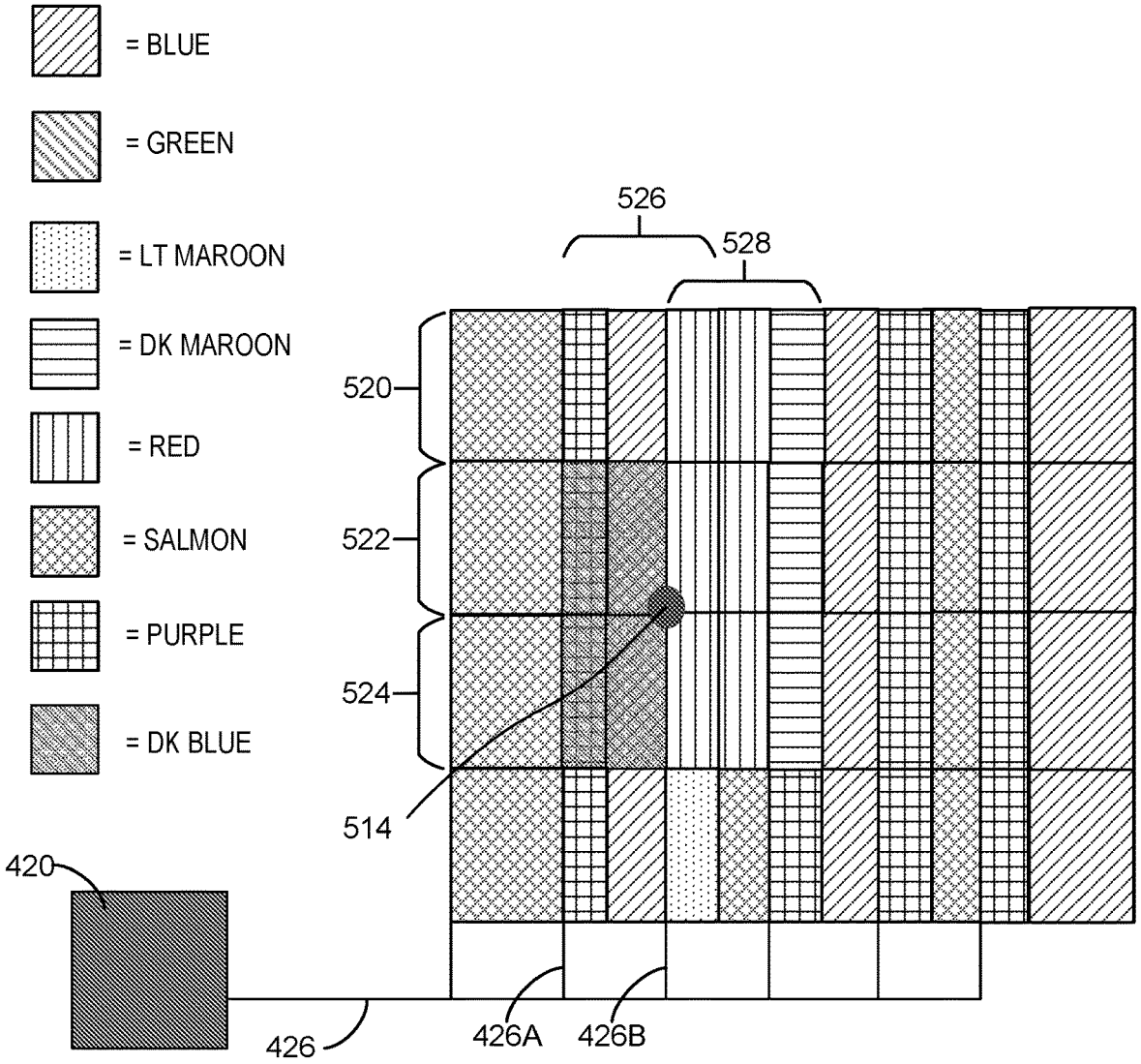
FIG. 8 is an example analysis of a hit at the interface of two patches and a wire lead bundle.

FIG. 8 is an example analysis of a hit at the interface of two patches and a wire lead bundle. In the example of FIG. 8, projectile impact 514 occurred at the interface between the two patches in column 526, the patch in row 522 and the patch in row 524. Because the impact point is at the interface of these two blue patches, both of these blue patches are out of play for further impacts. Since projectile impact 514 also hit wire lead bundle 426B, which contains the wire leads from the red patches in row 520, row 522, and row 524 of column 528, these three red patches are also out of play for further impacts. It should be noted that the blue patch in row 520 and column 526 is undamaged by the projectile impact 514 since the wire lead for this patch runs vertically down wire lead bundle 426A.

Figure 9:
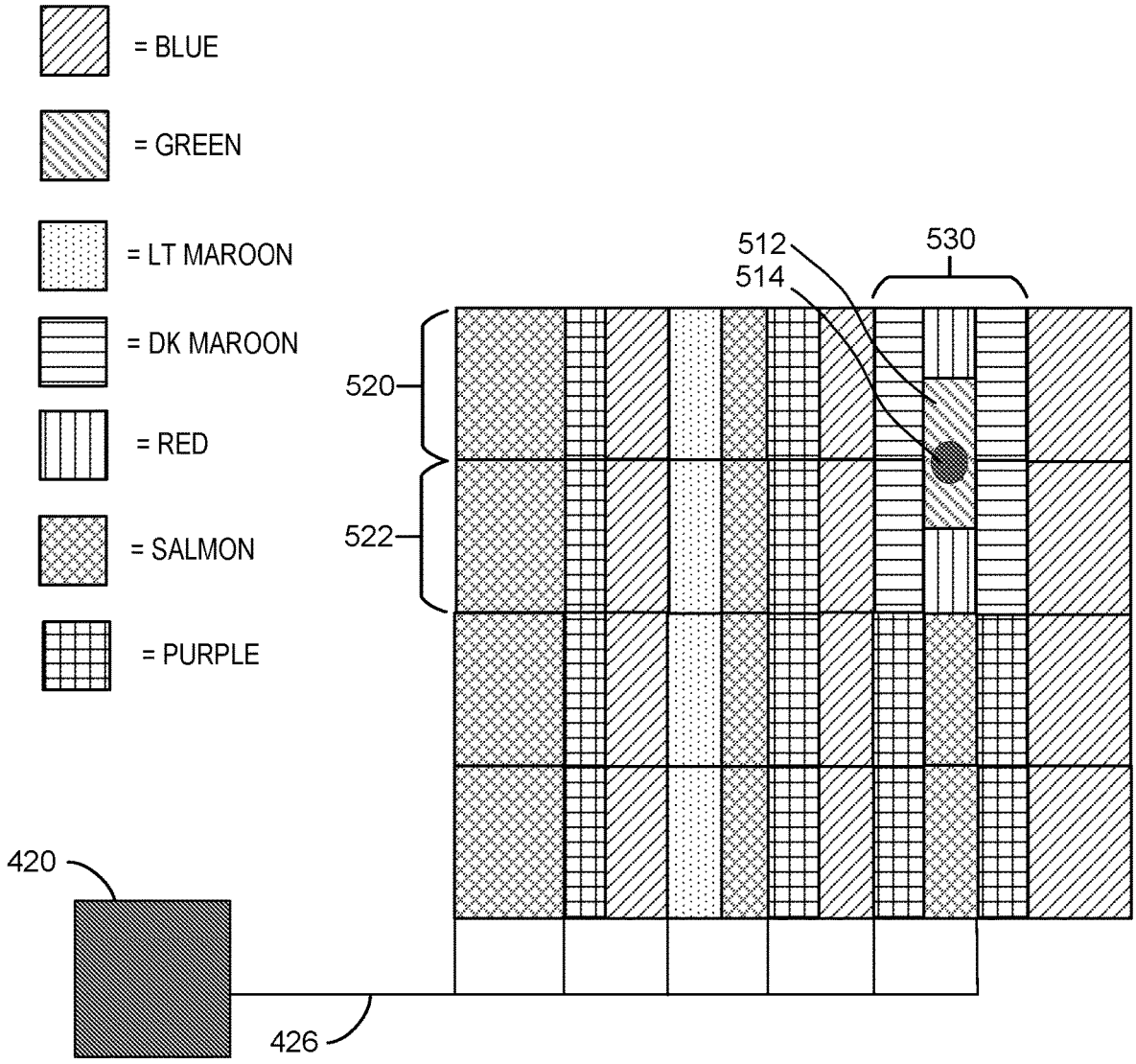
FIG. 9 is an example analysis of a hit where two patches are hit, but not at an overlap or a wire lead bundle.

FIG. 9 is an example analysis of a hit where two patches are hit, but not at an overlap or a wire lead bundle. In the example of FIG. 9, projectile impact 514 occurred within column 530, but not within the overlap with any other columns. Since projectile impact 514 hit the red patches in both row 520 and row 522, both red patches in column 530 are out of play for further impacts. No additional patches, however, are out of play for further impacts, and all remaining patches may detect further impacts. Based on the analysis of the damaged patches, overlap zone 512 is reported to be the area of the hit.

Figure 10:
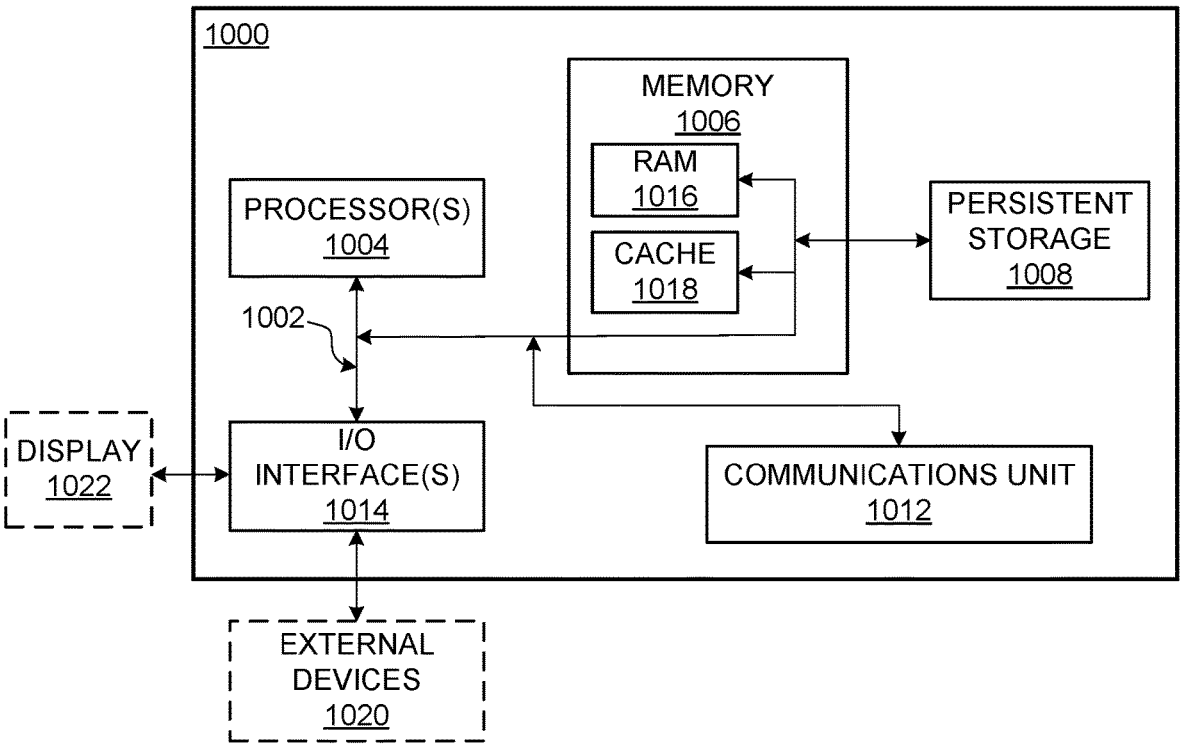
FIG. 10 is a block diagram depicting components of one example of a computing device suitable for hit detection, in accordance with at least one embodiment of the disclosure.

FIG. 10 is a block diagram depicting components of one example of the computing device, e.g., controller 420, suitable for hit detection, in accordance with at least one embodiment of the disclosure. FIG. 10 displays the computing device or computer 1000, one or more processor(s) 1004 (including one or more computer processors), a communications fabric 1002, a memory 1006 including, a random-access memory (RAM) 1016 and a cache 1018, a persistent storage 1008, a communications unit 1012, I/O interfaces 1014, a display 1022, and external devices 1020. It should be appreciated that FIG. 10 provides only an illustration of one embodiment and does not imply any limitations with regard to the environments in which different embodiments may be implemented. Many modifications to the depicted environment may be made.

As depicted, the computer 1000 operates over the communications fabric 1002, which provides communications between the computer processor(s) 1004, memory 1006, persistent storage 1008, communications unit 1012, and input/output (I/O) interface(s) 1014. The communications fabric 1002 may be implemented with an architecture suitable for passing data or control information between the processors 1004 (e.g., microprocessors, communications processors, and network processors), the memory 1006, the external devices 1020, and any other hardware components within a system. For example, the communications fabric 1002 may be implemented with one or more buses.

The memory 1006 and persistent storage 1008 are computer readable storage media. In the depicted embodiment, the memory 1006 comprises a RAM 1016 and a cache 1018. In general, the memory 1006 can include any suitable volatile or non-volatile computer readable storage media. Cache 1018 is a fast memory that enhances the performance of processor(s) 1004 by holding recently accessed data, and near recently accessed data, from RAM 1016.

Program instructions for hit detection may be stored in the persistent storage 1008, or more generally, any computer readable storage media, for execution by one or more of the respective computer processors 1004 via one or more memories of the memory 1006. The persistent storage 1008 may be a magnetic hard disk drive, a solid-state disk drive, a semiconductor storage device, flash memory, read only memory (ROM), electronically erasable programmable read-only memory (EEPROM), or any other computer readable storage media that is capable of storing program instruction or digital information.

The media used by persistent storage 1008 may also be removable. For example, a removable hard drive may be used for persistent storage 1008. Other examples include optical and magnetic disks, thumb drives, and smart cards that are inserted into a drive for transfer onto another computer readable storage medium that is also part of persistent storage 1008.

The communications unit 1012, in these examples, provides for communications with other data processing systems or devices. In these examples, the communications unit 1012 includes one or more network interface cards. The communications unit 1012 may provide communications through the use of either or both physical and wireless communications links. In the context of some embodiments of the present disclosure, the source of the various input data may be physically remote to the computer 1000 such that the input data may be received, and the output similarly transmitted via the communications unit 1012.

The I/O interface(s) 1014 allows for input and output of data with other devices that may be connected to computer 1000. For example, the I/O interface(s) 1014 may provide a connection to external device(s) 1020 such as a keyboard, a keypad, a touch screen, a microphone, a digital camera, and/or some other suitable input device. External device(s) 1020 can also include portable computer readable storage media such as, for example, thumb drives, portable optical or magnetic disks, and memory cards. Software and data used to practice embodiments of the present disclosure can be stored on such portable computer readable storage media and can be loaded onto persistent storage 1008 via the I/O interface(s) 1014. I/O interface(s) 1014 also connect to a display 1022.

Display 1022 provides a mechanism to display data to a user and may be, for example, a computer monitor. Display 1022 can also function as a touchscreen, such as a display of a tablet computer.

According to one aspect of the present disclosure, there is thus provided an apparatus for hit detection. The apparatus includes: a plurality of hit detection patches, each of the plurality of hit detection patches comprising an associated single coiled wire, and each of the plurality of hit detection patches being disposed overlapping at least one other hit detection patch of the plurality of hit detection patches; and a controller coupled to the associated single coiled wire of each hit detection patch of the plurality of hit detection patches, the controller configured to determine a location of one or more of the plurality of hit detection patches impacted by a projectile.

According to another aspect of the disclosure, there is provided a system for hit detection. The system includes: a plurality of hit detection patches, each of the plurality of hit detection patches comprising an associated single coiled wire, and each of the plurality of hit detection patches being disposed overlapping at least one other hit detection patch of the plurality of hit detection patches; and a controller, the controller configured to: detect a loss of continuity in the associated single coiled wire in one or more impacted hit detection patches of the plurality of hit detection patches; and determine a location impacted by a projectile based on a position of the one or more impacted hit detection patches.

According to yet another aspect of the present disclosure, there is thus provided an apparatus. The apparatus includes: a plurality of hit detection patches, each of the plurality of hit detection patches comprising an associated single coiled wire; and a controller coupled to the associated single coiled wire of each hit detection patch of the plurality of hit detection patches, the controller configured to: detect an impact by one or more projectiles based on a loss of continuity in the associated single coiled wire of one or more hit detection patches of the plurality of hit detection patches; and determine a location impacted by each of the one or more projectiles based on a position of the one or more hit detection patches of the plurality of hit detection patches having the loss of continuity.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto.

Embodiments of the methods described herein may be implemented using a controller, processor and/or other programmable device. To that end, the methods described herein may be implemented on a tangible, non-transitory computer readable medium having instructions stored thereon that when executed by one or more processors perform the methods. Thus, for example, the persistent storage 1008 may store instructions (in, for example, firmware or software) to perform the operations described herein. The storage medium, e.g. the persistent storage 1008, may include any type of tangible medium, for example, any type of disk optical disks, compact disk read-only memories (CD-ROMs), compact disk rewritables (CD-RWs), and magneto-optical disks, semiconductor devices such as read-only memories (ROMs), random access memories (RAMs) such as dynamic and static RAMs, erasable programmable read-only memories (EPROMs), electrically erasable programmable read-only memories (EEPROMs), flash memories, magnetic or optical cards, or any type of media suitable for storing electronic instructions.

It will be appreciated by those skilled in the art that any block diagrams herein represent conceptual views of illustrative circuitry embodying the principles of the disclosure. Similarly, it will be appreciated that any block diagrams, flow charts, flow diagrams, state transition diagrams, pseudocode, and the like represent various processes which may be substantially represented in computer readable medium and so executed by a computer or processor, whether or not such computer or processor is explicitly shown. Software modules, or simply modules which are implied to be software, may be represented herein as any combination of flowchart elements or other elements indicating performance of process steps and/or textual description. Such modules may be executed by hardware that is expressly or implicitly shown.

The functions of the various elements shown in the figures, including any functional blocks labeled as a controller or processor, may be provided through the use of dedicated hardware as well as hardware capable of executing software in association with appropriate software. The functions may be provided by a single dedicated processor, by a single shared processor, or by a plurality of individual processors, some of which may be shared. Moreover, explicit use of the term controller or processor should not be construed to refer exclusively to hardware capable of executing software, and may implicitly include, without limitation, digital signal processor (DSP) hardware, network processor, application specific integrated circuit (ASIC), field programmable gate array (FPGA), read-only memory (ROM) for storing software, random access memory (RAM), and non-volatile storage. Other hardware, conventional and/or custom, may also be included.

The term "coupled" as used herein refers to any connection, coupling, link, or the like by which signals carried by one system element are imparted to the "coupled" element. Such "coupled" devices, or signals and devices, are not necessarily directly connected to one another and may be separated by intermediate components or devices that may manipulate or modify such signals.

Unless otherwise stated, use of the word "substantially" may be construed to include a precise relationship, condition, arrangement, orientation, and/or other characteristic, and deviations thereof as understood by one of ordinary skill in the art, to the extent that such deviations do not materially affect the disclosed methods and systems. Throughout the entirety of the present disclosure, use of the articles "a" and/or "an" and/or "the" to modify a noun may be understood to be used for convenience and to include one, or more than one, of the modified noun, unless otherwise specifically stated. The terms "comprising", "including" and "having" are intended to be inclusive and mean that there may be additional elements other than the listed elements.

The descriptions of the various embodiments of the present disclosure have been presented for purposes of illustration but are not intended to be exhaustive or limited to the embodiments disclosed. Many modifications and variations will be apparent to those of ordinary skill in the art without departing from the scope and spirit of the disclosure. The terminology used herein was chosen to best explain the principles of the embodiment, the practical application or technical improvement over technologies found in the marketplace, or to enable others of ordinary skill in the art to understand the embodiments disclosed herein.

What is claimed is:

1. An apparatus for hit detection, the apparatus comprising:

a plurality of hit detection patches, each of the plurality of hit detection patches comprising an associated single coiled wire, and each of the plurality of hit detection patches being disposed overlapping at least one other adjacent hit detection patch of the plurality of hit detection patches on the same plane; and a controller coupled to the associated single coiled wire of each hit detection patch of the plurality of hit detection patches, the controller configured to determine a location of one or more of the plurality of hit detection patches impacted by a projectile.

2. The apparatus of claim 1, wherein the location of the one or more of the plurality of hit detection patches impacted by the projectile is determined based on a loss of continuity of the associated single coiled wire of the one or more of the plurality of hit detection patches impacted by the projectile.

3. The apparatus of claim 1, wherein each of the plurality of hit detection patches further comprises wire leads to couple each of the plurality of hit detection patches to the controller.

4. The apparatus of claim 3, wherein the wire leads for at least two hit detection patches of the plurality of hit detection patches are coupled in a bundle, wherein the bundle contains the wire leads from all the hit detection patches in a row or a column.

5. The apparatus of claim 4, wherein the bundle is positioned beneath an area of overlapping at least one other hit detection patch.

6. The apparatus of claim 1, wherein the controller is further configured to provide an output representative of the location of the one or more of the plurality of hit detection patches impacted by the projectile.

7. A system for hit detection comprising:

a plurality of hit detection patches, each of the plurality of hit detection patches comprising an associated single coiled wire, and each of the plurality of hit detection patches being disposed overlapping at least one other adjacent hit detection patch of the plurality of hit detection patches on the same plane; and a controller, the controller configured to:

detect a loss of continuity in the associated single coiled wire in one or more impacted hit detection patches of the plurality of hit detection patches; and determine a location impacted by a projectile based on a position of the one or more impacted hit detection patches.

8. The system of claim 7, wherein the controller is further configured to provide an output representative of the location of the one or more impacted hit detection patches.

9. The system of claim 7, wherein each of the plurality of hit detection patches further comprises wire leads to couple each of the plurality of hit detection patches to the controller.

10. The system of claim 9, wherein the wire leads for at least two of the plurality of hit detection patches are coupled in a bundle, wherein the bundle contains the wire leads from all the hit detection patches in a row or a column.

11. The system of claim 10, wherein the bundle is positioned beneath an area of overlapping at least one other hit detection patch.

12. An apparatus comprising:

a plurality of hit detection patches disposed on a surface of a single substrate, each of the plurality of hit detection patches comprising an associated single coiled wire; and a controller coupled to the associated single coiled wire of each hit detection patch of the plurality of hit detection patches, the controller configured to:

detect an impact by one or more projectiles based on a loss of continuity in the associated single coiled wire of one or more hit detection patches of the plurality of hit detection patches; and determine a location impacted by each of the one or more projectiles based on a position of the one or more hit detection patches of the plurality of hit detection patches having the loss of continuity.

13. The apparatus of claim 12, wherein one or more of the plurality of hit detection patches being disposed overlapping at least one other adjacent hit detection patch of the plurality of hit detection patches on the same plane.

14. The apparatus of claim 12, wherein each of the plurality of hit detection patches in a column being disposed overlapping at least one other hit detection patch in an adjacent column.

15. The apparatus of claim 12, wherein each of the plurality of hit detection patches further comprises wire leads to couple each of the plurality of hit detection patches to the controller.

16. The apparatus of claim 15, wherein the wire leads for at least two hit detection patches of the plurality of hit detection patches are coupled in a bundle, wherein the bundle contains the wire leads from all the hit detection patches in a row or a column.

17. The apparatus of claim 16, wherein the bundle is positioned beneath an area of overlapping at least one other hit detection patch.

18. The apparatus of claim 12, wherein the controller is further configured to provide an output representative of the location of the one or more hit detection patches of the plurality of hit detection patches impacted by the projectiles.

* * * * *